US006165409A

United States Patent [19]

Dubois et al.

[11] Patent Number: 6,165,409

[45] Date of Patent: Dec. 26, 2000

[54] MOLTEN STEEL TRANSFER ELEMENT AND ITS MANUFACTURING

[75] Inventors: Pascal Dubois, Feignes, France; Eric Hanse, Dour, Belgium

[73] Assignee: Vesuvius Crucible Company, Wilmington, Del.

[21] Appl. No.: 09/284,370

[22] PCT Filed: Oct. 22, 1997

[86] PCT No.: PCT/EP97/05822

§ 371 Date: Jun. 7, 1999

§ 102(e) Date: Jun. 7, 1999

[87] PCT Pub. No.: WO98/17422

PCT Pub. Date: Apr. 30, 1998

[30] Foreign Application Priority Data

Oct. 23, 1996 [FR] France ..... 96 13017

[51] Int. Cl.[7] ..... B22D 11/10

[52] U.S. Cl. ..... 264/610; 164/437; 222/606

[58] Field of Search ..... 164/437, 337; 222/606, 607; 264/317, 610, 629, 635

[56] References Cited

U.S. PATENT DOCUMENTS 4,776,502 10/1988 Hagenburger et al. .

5,188,167 2/1993 Perry et al. .

5,348,075 9/1994 Perry et al. .

5,402,993 4/1995 Hofman et al. .

5,716,538 2/1998 Poloni et al. ..... 164/437

FOREIGN PATENT DOCUMENTS 589762 3/1994 European Pat. Off. .

2733705 11/1996 France .

6218508 8/1994 Japan .

*Primary Examiner*—Kuang Y. Lin

*Attorney, Agent, or Firm*—James R. Williams

[57] ABSTRACT

The invention concerns a transfer element for transferring molten steel between an upstream container such as a tundish and a downstream vessel such as a continuous casting mold. this element is comprised of a body (4) that delimits a steel entrance zone, a channel (6) and a steel exit zone (9). It has at least one divider (16) in its exit zone (9) for dividing the steel flux into at least two jets. The divider is comprised of two parts of complementary form (19) solid with the body (4), located opposite each other and separated by an interstice (18).

5 Claims, 1 Drawing Sheet

MOLTEN STEEL TRANSFER ELEMENT AND ITS MANUFACTURING

BACKGROUND OF THE INVENTION

The present invention concerns a transfer element for the transfer of molten steel between an upstream container such as a tundish and a downstream vessel such as a continuous casting mold, the said element having a body delimiting a steel entrance zone, a channel and a steel exit zone.

In the field of continuous casting, it is common practice to transfer the molten steel from an upstream container such as a tundish to a downstream vessel such as a continuous casting mold by means of transfer elements, e.g., a pouring spout or a tube, that protect the molten steel from the air and thus improve the quality of the metal cast.

In order to assure the best possible quality of the poured steel, several requirements should be met. The steel should arrive in the channel as slowly as possible. It should be uniformly distributed. It should cool in a homogeneous manner to assure a constant crystallization. The steel should not arrive close to the walls because it is through them that heat removal takes place (water cooling). The steel would thus be cooled too rapidly at the level of the walls and not enough in the center of the mold, which would result in a lack of homogeneity in cooling. Finally, it is necessary to avoid the formation of eddies that would entrain the cover powder, which would form inclusions in the steel.

SUMMARY OF THE INVENTION

The present invention proposes a transfer element that permits attaining these objectives.

According to the invention, the element has at least one divider in its exit zone for dividing the steel flow into at least two streams and this divider is comprised of two parts of complementary shape solid with the body, situated opposite each other and separated by an interstice.

The fact that the divider is comprised of two parts permits a free expansion of the walls of the body and avoids the appearance of cracks in the lower part of the element.

The exit zone can have quite diverse forms. For example, it can be circular. However, in order to bring the steel as much as possible to the center of the mold away from the walls, an elongated section would be preferred. The interstice is preferably vertical and located in a vertical plane parallel to the large dimension of the elongated section.

The interstice can be plane or have a sinuous form.

Another object of the present invention is a process for manufacturing an element for transferring molten steel from an upstream container such as a tundish to a downstream vessel such as a continuous casting mold, the said element being comprised of a body that delimits a steel entrance zone, a channel and a steel exit zone.

The process is characterized in that:

- a separation element is placed in a flexible mold at the site where one wishes to have an interstice between the two parts of the divider;
- the mold is filled with a mixture of refractory powder and it is pressed isostatically;
- the separation element is withdrawn;
- the element is baked.

Other characteristics and advantages of the present invention will appear from reading the following description with reference to the attached figures.

DETAILED DESCRIPTION OF THE INVENTION

Figure 1:
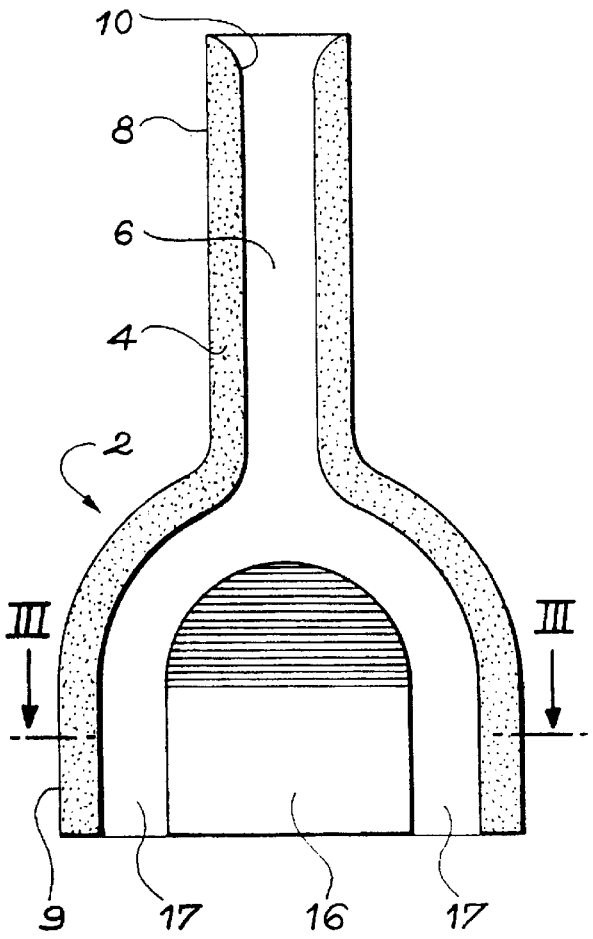
FIG. 1 is a longitudinal sectional view along the section I—I of a spout according to the present invention.
Figure 2:
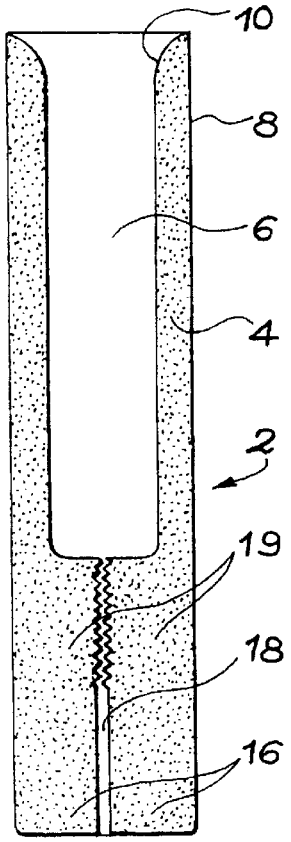
FIG. 2 is a cross sectional view along the line II—II of the spout shown in FIG. 1.
Figure 3:
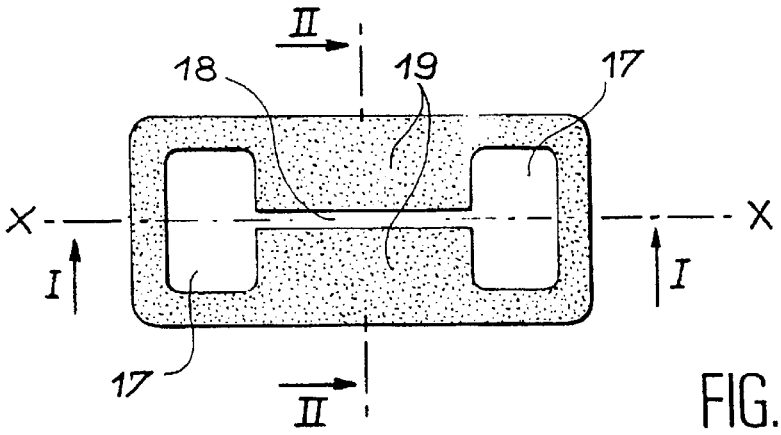
FIG. 3 is a sectional view of the spout shown in FIGS. 1 and 2.

The spout 2 shown in FIGS. 1–3 has an elongated body 4 of a refractory material.

This body delimits a pouring channel 6 for the passage of a molten metal, generally steel, from an upstream container to a downstream vessel. The upper part 8 of the body 4 is designed to be mounted on the thickness of the refractory wall covering the bottom wall of the upstream container, e.g., a tundish (not shown). A seat 10 is located in the upper part of the body 4; it is rounded and is designed to receive a stopper rod that makes it possible to interrupt and control the pouring of the molten steel. In the lower part 9 of the body 4 there is a divider 16 that delimits two separate exit orifices 17. The divider is comprised of two parts 19, each solid with the wall of the body 4, which is parallel with the longitudinal axis X—X of the exit section of the element (see FIG. 3). The two parts 19 leave an interstice 18 between them, the width of which can range from 1/10 of a millimeter to several millimeters.

This interstice 18 can be plane or have another shape, e.g., a sinusoidal or irregular shape. It can be placed in the median plane of the element or offset with regard to this plane. It can also be positioned obliquely with regard to this plane.

Since the divider 16 is comprised of two independent parts, the walls of the body can deviate from each other. The stresses concentrated at the level of the divider are thus prevented from appearing at the time of firing the element. Such stresses would result in the appearance of cracks at the time of pouring.

The interstice 18 is placed at a point on the element where it is not troublesome for the flow of the steel stream. Its orientation, position and range are controlled. It prevents other uncontrolled cracks from appearing in the element at the time when the pouring begins ; these cracks could cause a rupture of the element.

The interstice can be obtained in various ways. According to a preferred procedure, a flexible mold is used, into which a central mandrel is introduced. A powder of a refractory mixture is introduced into the mold. The mandrel delimits the space of the central channel 6 and the two exit orifices 17. The mold is placed such that the lower part of the element is above and is filled last.

According to the invention process, a separation element is placed in the mold at the site where the interstice is desired between the two parts 19 of the divider. The filling of the mold is then terminated. Then it is pressed isostatically. The separation element, e.g., a blade of metal, is then removed. Or a thermo-eliminable separation element is used, for example, a sheet of plastic, which is then left in place and it will be eliminated when the piece is fired.

The invention is applicable to any element for transferring molten steel from one receptacle to another since it has at its lower end two or more louvers separated by divider(s).

In particular, it is applicable to a plate/tube assembly for a tube change. The tube changing can be rectilinear or rotary, as for example that described in the French application No. 2 733 705.

What is claimed is:

1. A transfer element for transferring molten metal between an upstream container and a downstream container, the transfer element comprising a body having an inlet zone, an exit zone, and a channel connecting the inlet zone and the exit zone through which molten metal may flow, the exit zone having at least one divider for dividing the molten metal into at least two streams, the divider comprising at least two complimentary parts separated by at least one interstice.

2. The transfer element of claim 1, wherein the interstice is located in a plane parallel to a larger dimension of the exit zone.

3. A method of manufacturing a transfer element comprising a body having an inlet zone, an exit zone, and a channel connecting the inlet zone and the exit zone through which molten metal may flow, the exit zone having at least one divider for dividing the molten metal into at least two streams, the divider comprising at least two complimentary parts separated by at least one interstice, the method comprising:

(a) placing a separation element in a flexible mold at a location corresponding to the interstice;

(b) filling the mold with a mixture of refractory powder;

(c) pressing the filled mold; and (d) removing the separation element.

4. The method of claim 3, wherein the separation element is removed by firing the transfer element.

5. The method of claim 3, wherein pressing is isostatic pressing.

* * * * *